US009073724B2

(12) United States Patent
Uehara et al.

(10) Patent No.: US 9,073,724 B2
(45) Date of Patent: Jul. 7, 2015

(54) SHEET DISCHARGE DEVICE AND IMAGE FORMING APPARATUS

(71) Applicants: Kentaro Uehara, Tokyo (JP); Tamotsu Ikeda, Tokyo (JP); Yoo Dongkyu, Tokyo (JP); Park Sungkyu, Tokyo (JP)

(72) Inventors: Kentaro Uehara, Tokyo (JP); Tamotsu Ikeda, Tokyo (JP); Yoo Dongkyu, Tokyo (JP); Park Sungkyu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/291,884

(22) Filed: May 30, 2014

(65) Prior Publication Data

US 2014/0374987 A1 Dec. 25, 2014

(30) Foreign Application Priority Data

Jun. 25, 2013 (JP) ..... 2013-132961

(51) Int. Cl.

| | |
|---|---|
| ***B65H 29/70*** | (2006.01) |
| ***G03G 15/00*** | (2006.01) |
| ***B65H 31/34*** | (2006.01) |
| ***B65H 5/06*** | (2006.01) |

(52) U.S. Cl.

CPC ..... *B65H 29/70* (2013.01); *B65H 31/34* (2013.01); *B65H 5/06* (2013.01); *B65H 2301/51256* (2013.01); *G03G 15/6576* (2013.01); *G03G 2215/00662* (2013.01)

(58) Field of Classification Search

CPC ..... G03B 15/6576; G03G 2115/00662; G03G 15/6576; B65H 2301/51256; B65H 29/70

USPC ..... 271/188; 399/406

See application file for complete search history.

(56) References Cited

U.S. PATENT DOCUMENTS

| | | | | |
|---|---|---|---|---|
| 5,565,971 | A * | 10/1996 | Kuo et al. | 399/406 |
| 5,848,347 | A * | 12/1998 | Kuo et al. | 399/406 |
| 6,003,864 | A * | 12/1999 | Kuo et al. | 271/272 |
| 8,538,316 | B2 * | 9/2013 | Shigeno et al. | 399/406 |
| 8,864,133 | B2 * | 10/2014 | Takai et al. | 271/272 |
| 2011/0176821 | A1 | 7/2011 | Hase | |
| 2014/0153991 | A1 * | 6/2014 | Koyanagi et al. | 399/406 |

FOREIGN PATENT DOCUMENTS

| | | |
|---|---|---|
| JP | 2002-12336 | 1/2002 |
| JP | 2007-217187 | 8/2007 |
| JP | 2009-113929 | 5/2009 |

* cited by examiner

*Primary Examiner* — Patrick Cicchino

(74) *Attorney, Agent, or Firm* — Oblon, McClelland, Maier & Neustadt, L.L.P.

(57) ABSTRACT

A sheet discharge device includes a fixing device that fixes a sheet, a curl correcting device that corrects a curl of the fixed sheet, a first guiding member that guides the fixed sheet in a sheet discharging direction, a second guiding member that guides the fixed sheet in the sheet discharging direction and is arranged on a side opposite to the first guiding member, a support part that rotatably supports the first guiding member, and an engaging part that engages with the support part. The curl correcting device includes a correcting roller that is attached to the first guiding member. The engaging part includes a hole including an oblong shape so that the first guiding member is movable apart from the second guiding member. An image forming apparatus includes an image forming device that forms an image on a sheet, and the sheet discharge device.

11 Claims, 11 Drawing Sheets

SHEET DISCHARGE DEVICE AND IMAGE FORMING APPARATUS

CROSS REFERENCE TO RELATED APPLICATION

The present application claims the benefit of priority under 35 U.S.C. §119 from Japanese Patent Application No. JP 2013-132961, filed on Jun. 25, 2013. The entire contents of Japanese Patent Application No. JP 2013-132961 are incorporated herein by reference.

BACKGROUND OF THE INVENTION

I. Field of the Invention

Exemplary aspects of the present application generally relate to a sheet discharge device and an image forming apparatus.

II. Background Art

Conventionally, in an image forming apparatus such as a copier, a facsimile, a printer, and a printing machine, or the like, a copied material or a printed material is generated by heating and fixing an unfixed image, which is transferred and is supported on a recording medium.

On the other hand, a sheet with a fixed image often has a curl due to heating and pressure during fixing. Therefore a failure in conveyance of a sheet may occur when a curled sheet is conveyed after fixing the sheet. Conventionally, to prevent the failure in conveyance of a sheet due to a sheet jam, a sheet discharged after fixing is curled in an inverse direction of a curl. As such, the curled sheet is corrected.

JP 2009-113929 discloses a structure to correct a curl in which each of a facing roller pair has a different hardness and a rotating speed of the roller pair is changed according to a thickness and kind of a sheet.

JP 2007-217187 discloses a structure to correct a curl of a cardboard sheet or a thin sheet in which a guide plate to be curved in an inverse direction of a curl is arranged at a position just after the sheet passes a fixing device, and an angle of the plate is arranged so that a curl of the sheet is corrected.

JP 2002-12336 discloses that a conveying roller is separated from a counter roller to the conveying roller so that it is possible to remove a jammed sheet from those rollers.

However, the curl correcting mechanism which JP 2009-113929 and JP 2007-217187 disclose is arranged at a position just after where a sheet passes a fixing device. In this case, it is not considered that the sheet that has passed the curl correcting mechanism is curled again according to a shape of a conveying pass, such as an inverting pass. In other words, if a curl of the sheet corrected by the curl correcting mechanism is not completely removed at the fixing time, the sheet might be curled again in a process where the sheet moves in a curved pass.

On the other hand, in the case of JP 2002-12336, a special structure in which a roller pair is operated to contact and separate from each other is required, and this structure is not expected to remove a jam with a simple operation.

BRIEF SUMMARY OF THE INVENTION

In light of the problems and circumstances described above, a main object of the present application is to provide a sheet discharge device and an image forming apparatus in which a conveying pass is certainly opened and is exposed from an outside. As such, a jam can be removed easily.

According to an embodiment of the present application, a sheet discharge device includes: a fixing device that fixes a sheet, a curl correcting device that corrects a curl of the fixed sheet, a first guiding member that guides the fixed sheet in a sheet discharging direction, a second guiding member that guides the fixed sheet in the sheet discharging direction and is arranged on a side opposite to the first guiding member, a support part that rotatably supports the first guiding member, and an engaging part that engages with the support part. The curl correcting device includes a correcting roller that is attached to the first guiding member. The engaging part includes a hole including an oblong shape so that the first guiding member is movable apart from the second guiding member.

DETAILED DESCRIPTION OF THE INVENTION

Illustrative embodiments of the present application are described in detail with reference to the plural drawings.

Figure 1:
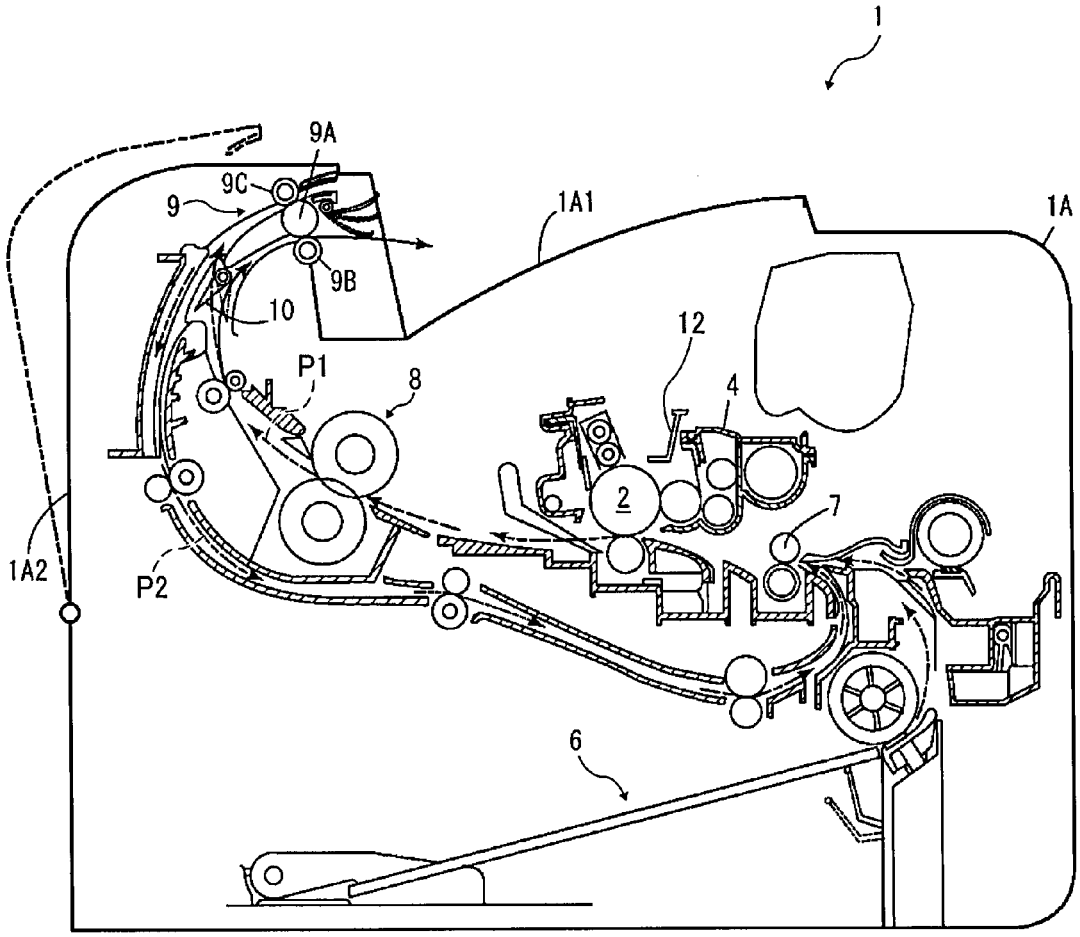
FIG. 1 is a diagram showing a schematic configuration of the image forming apparatus including a sheet discharge device, which shows an illustrative embodiment of the present application.

In FIG. 1, an image forming apparatus 1 includes a feeding device 6 for feeding a sheet, an image forming device 12 for forming an image on the sheet fed by the feeding device 6, a fixing device 8 for fixing an unfixed image which is formed on the sheet by the image forming device 12, and a discharge roller pair 9 for discharging the fixed sheet to a discharge tray 1A1.

The image forming device 12 includes a photoreceptor 2 for forming an electrostatic latent image on the outer surface according to image information, a developing device 4 for supplying toner to the photoreceptor 2 so that a toner image is formed on the photoreceptor 2, and a transfer device 7 for transferring the toner image on the photoreceptor 2 to the sheet fed by the feeding device 6, as an unfixed image.

The fixing device 8 includes a heating roller 8A and a pressure roller 8B which melt and permeate a toner image on a sheet so that the toner image is fixed on the sheet.

The image forming apparatus 1 includes a configuration for forming an image on one side and on both sides of a sheet. The configuration includes a discharge pass P1 for discharging a sheet which has passed the fixing device 8 to the discharge tray 1A1, and a switchback pass P2 for reversing a sheet.

A pass switch part 10 switches conveying directions of the sheet fixed by the fixing device 8. In a state in which the pass switch part 10 is shown by a solid line in FIG. 1, the fixed sheet is guided to a contacting position between a discharge driving roller 9A and a discharge driven roller 9B. In this state, the fixed sheet is discharged directly to the discharge tray 1A1.

On the other hand, in a state in which the pass switch part 10 is shown by a dashed line in FIG. 1, the fixed sheet is guided to a contacting position between the discharge driving roller 9A and a discharge driven roller 9C. In this state, once the fixed sheet is conveyed a predetermined amount by the discharge roller pair 9 in a discharging direction to the discharge tray 1A1, next, the fixed sheet is conveyed again to the switchback pass P2 by rotating the discharge roller pair 9 in a reverse direction.

Figure 2:
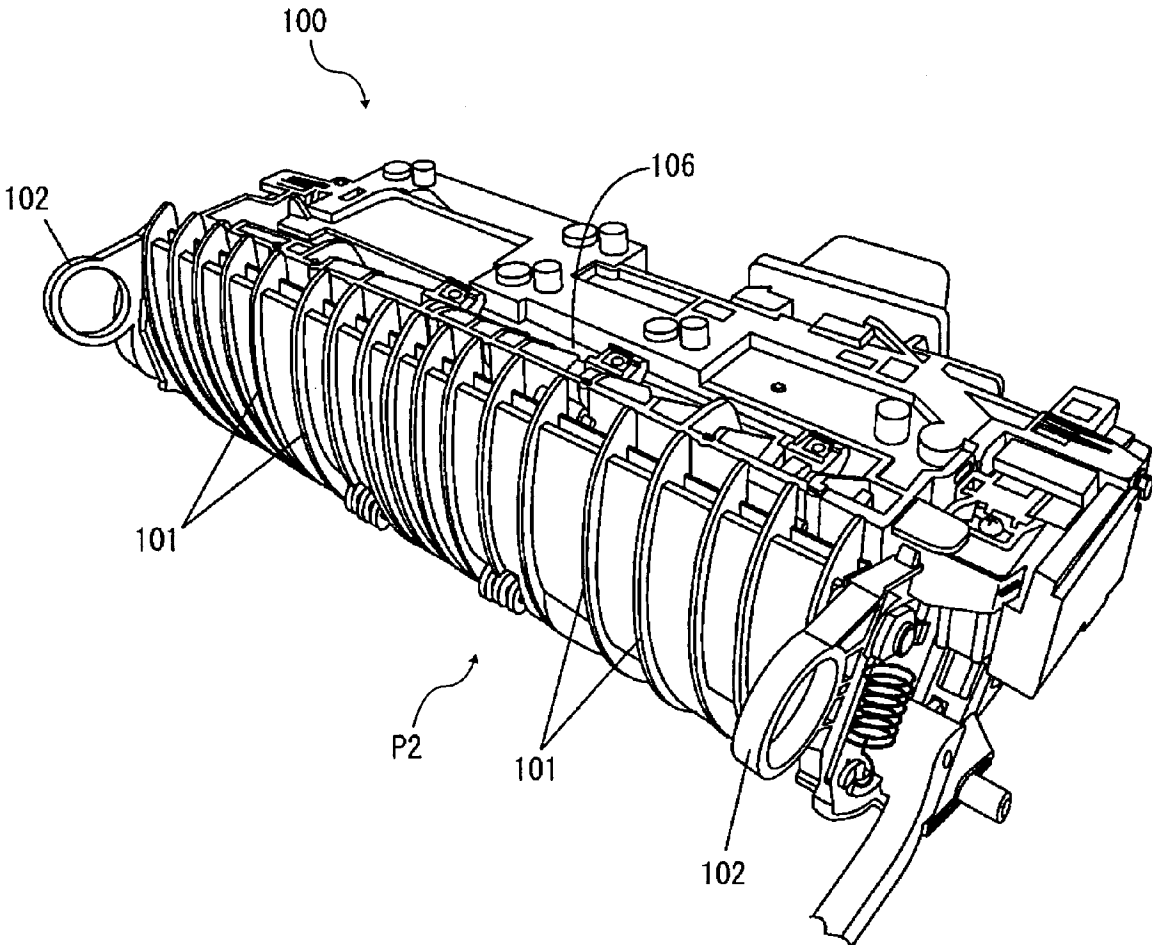
FIG. 2 is an external view of the sheet discharge device shown in FIG. 1.

In FIG. 2, a sheet discharge device 100 includes the fixing device 8, the discharge pass P1, and the switchback pass P2. One surface of the switchback pass P2 is a pass surface 101 included in the sheet discharge device 100. As such, an apparatus body 1A can be made compact.

The pass surface 101 includes a handle 102 which is used when the sheet discharge device 100 is attached to and removed from the apparatus body 1A.

In FIG. 1, the apparatus body 1A includes an openable cover 1A2 so that the sheet discharge device 100 can be attached to and removed from the apparatus body 1A.

Figure 3:
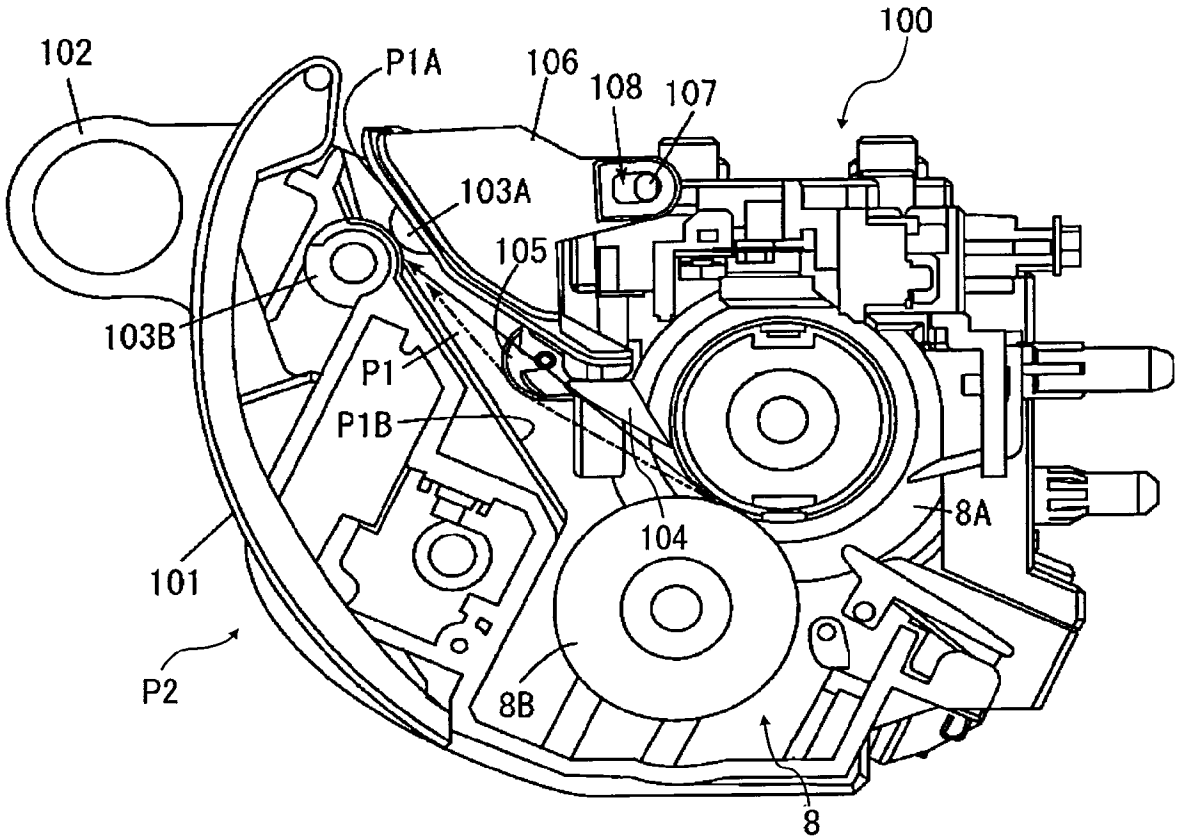
FIG. 3 is a diagram illustrating an internal configuration of the sheet discharge device, which shows an illustrative embodiment of the present application.
Figure 4:
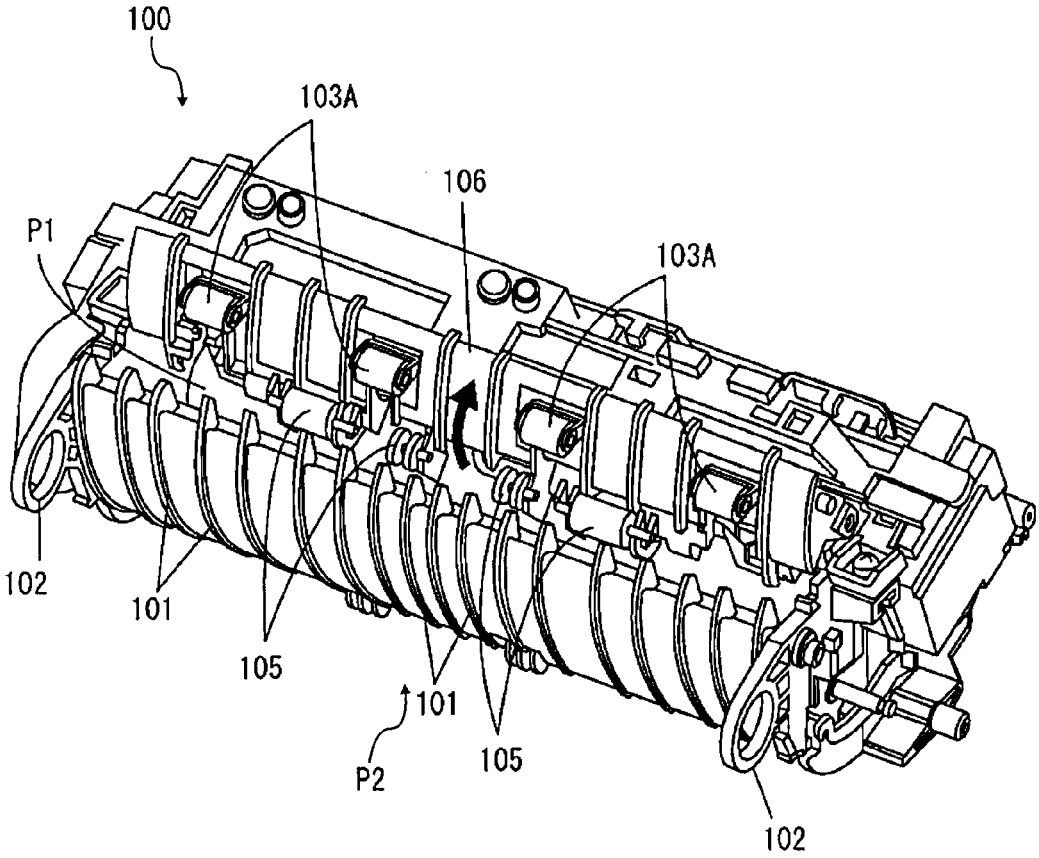
FIG. 4 is an external view showing a state in which a part of the sheet discharge device shown in FIG. 2 is opened.

In FIG. 3, a fixing device discharging roller pair 103A, 103B for discharging a sheet to the discharge roller pair 9 is arranged in the discharge pass P1.

In a configuration of the fixing device discharging roller pair 103A, 103B, the roller of the fixing device discharging roller pair 103A, 103B which contacts a surface opposite to a curled surface of the sheet, presses the other roller of the fixing device discharging roller pair 103A, 103B, so that the curl of the sheet is corrected.

In the sheet discharge device 100 shown in FIG. 3, a curl of the sheet that has passed the fixing device 8 is corrected by the fixing device discharging roller pair 103A, 103B, and a driven roller 105.

In FIG. 3, a sheet discharged from the fixing device 8 moves along a guide member 104.

An arrow shown with a solid line in FIG. 3 shows a direction in which a sheet discharged from the fixing device 8 moves to the fixing device discharging roller pair 103A, 103B, without being guided by the driven roller 105.

In an embodiment of the present application, an arrow shown with a dashed line in FIG. 3, shows a direction in which a sheet discharged from the fixing device 8 moves to the fixing device discharging roller pair 103A, 103B, while be guided by the driven roller 105. In other words, when the sheet discharged from the fixing device 8 reaches the driven roller 105, the direction in which the sheet moves changes to a direction apart from the guide member 104.

In a state when the sheet is held between the fixing device discharging roller 103A and the fixing device discharging roller 103B, the sheet is pressed in the direction apart from the guide member 104 by the driven roller 105. In addition, the curl of the sheet is corrected with the fixing device discharging roller pair 103A, 103B.

As such, an angle that the sheet is wound around the driven roller 105 can be made smaller than the angle without the fixing device discharging roller pair 103A, 103B. Therefore, this configuration prevents formation of a new curl in a reverse direction due to correction of the original curl of the sheet. In addition, the configuration prevents formation of the original curl again due to a shape restoring force of the sheet. Furthermore, the driven roller 105 prevents damaging an image on the sheet.

On the other hand, a discharge pass surface P1A is arranged facing a side of a sheet that is an image formed surface of the sheet discharged from the fixing device 8, and is attached to a guide member 106. The driven roller 105 is attached to the guide member 106.

In FIG. 3, a support shaft 107 is arranged at the sheet discharge device 100. An engaging part 108 has a hole of an oblong shape formed at the guide member 106, and is engaged with the support shaft 107. As such, the guide member 106 can rotate around the support shaft 107 in a direction shown with an arrow X in FIG. 5. In addition, the guide member 106 can move along the hole of oblong shape in the engaging part 108 in a direction shown with an arrow Y in FIG. 6.

Figure 5:
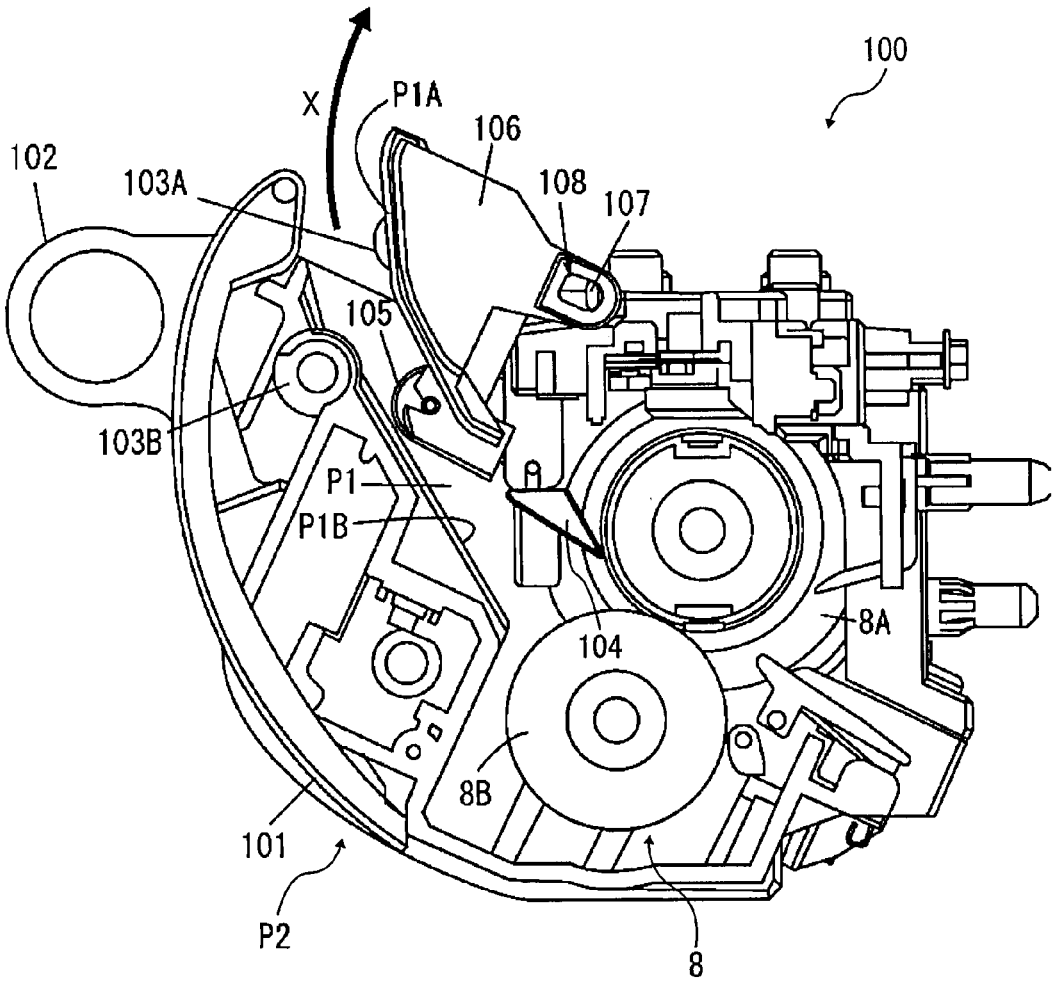
FIG. 5 is a diagram illustrating a first operation mode of the sheet discharge device shown in FIG. 2.
Figure 6:
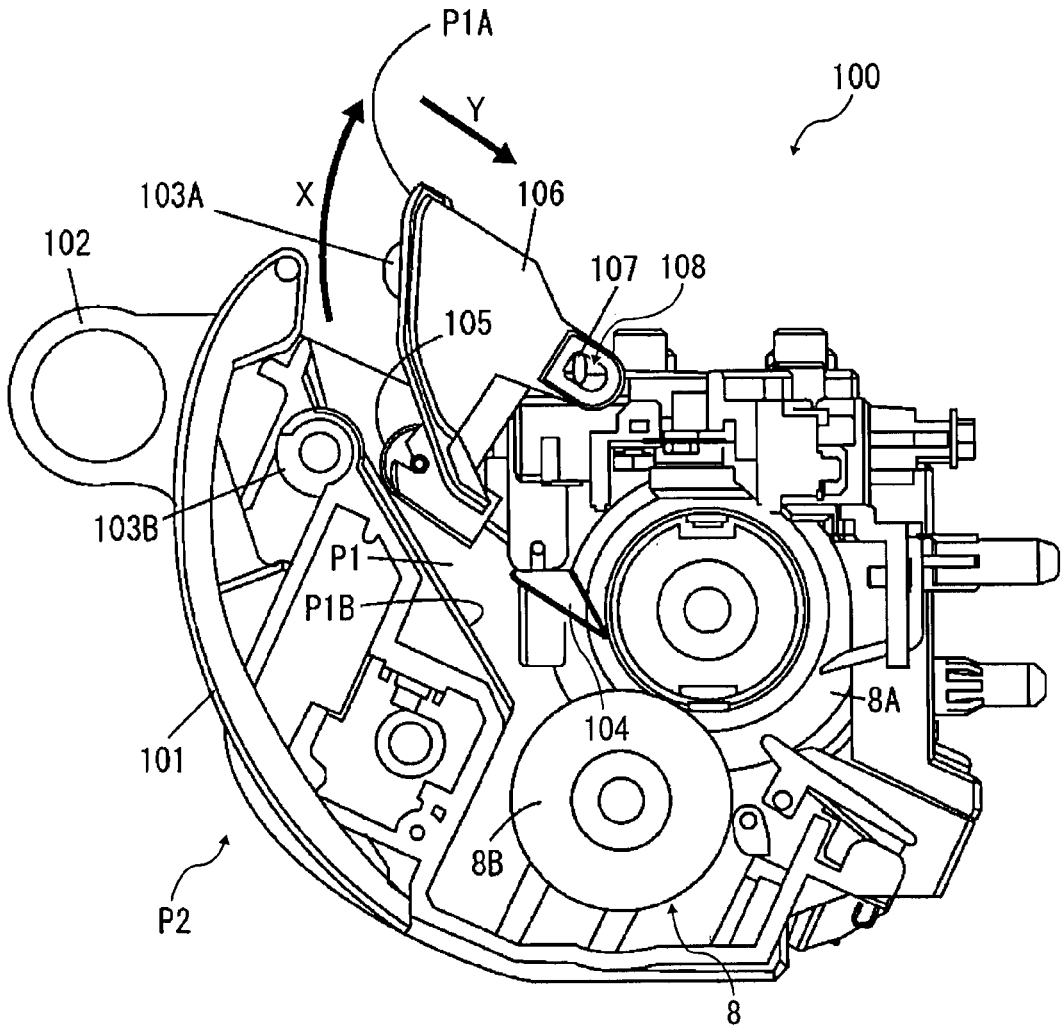
FIG. 6 is a diagram showing a second operation mode changed from the first operation mode shown in FIG. 5.
Figure 7:
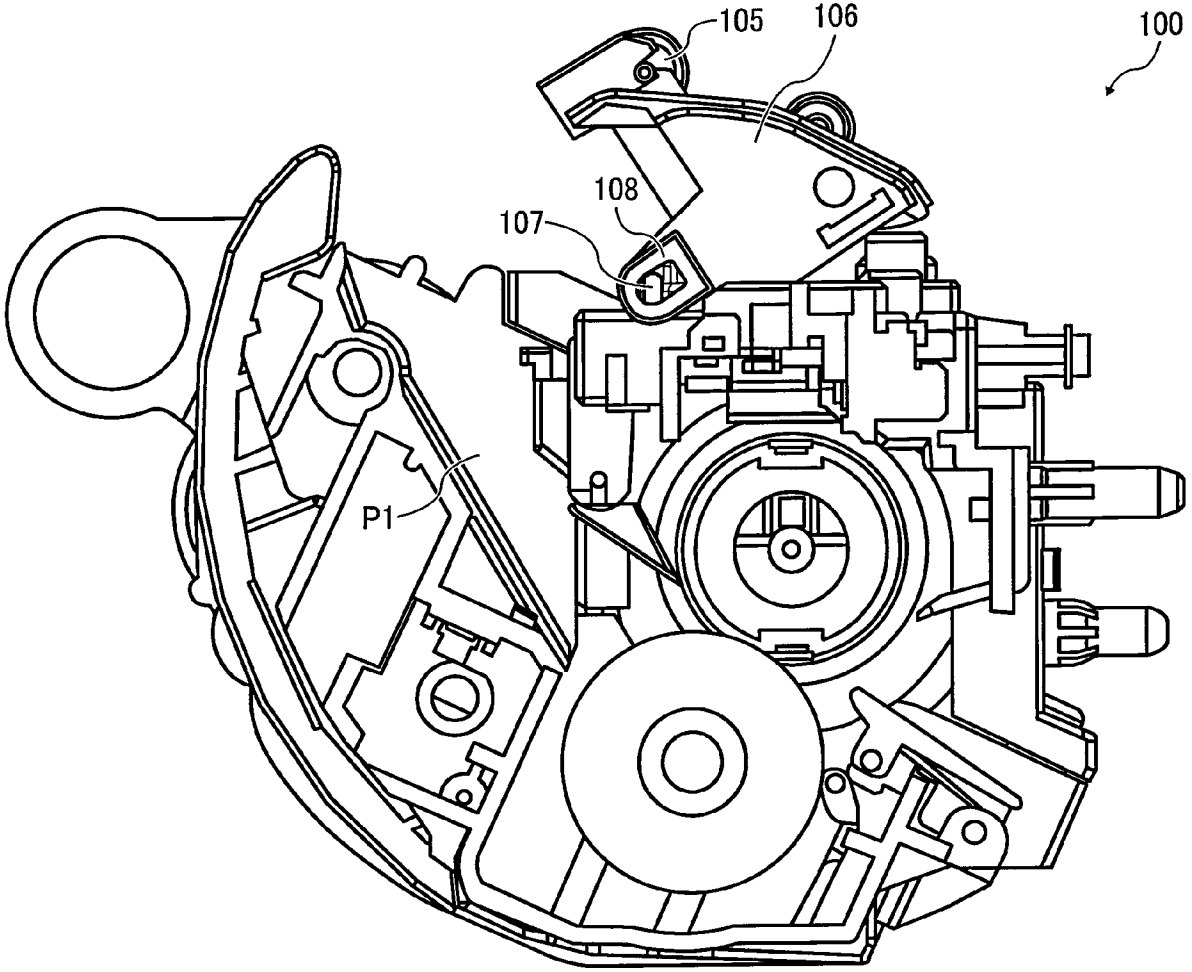
FIG. 7 is a diagram showing a third operation mode changed from the second operation mode shown in FIG. 6.

In FIG. 5, when the guide member 106 is rotated in the direction shown with the arrow X, at first, the driven roller 105 contacts a pass surface P1B. In addition, the guide member 106 moves along the oblong hole shape of the engaging part 108 in a direction shown with an arrow Y in FIG. 6. Furthermore, when the guide member 106 continues being rotated while the driven roller 105 is apart from the pass surface P1B, the discharge pass P1 is finally in an opened state as shown in FIG. 7.

The above configuration enables an operation to remove a jammed sheet speedily and to miniaturize the sheet discharge device, regardless of the fact that the sheet discharge device includes the curl correcting mechanism.

Figure 8:
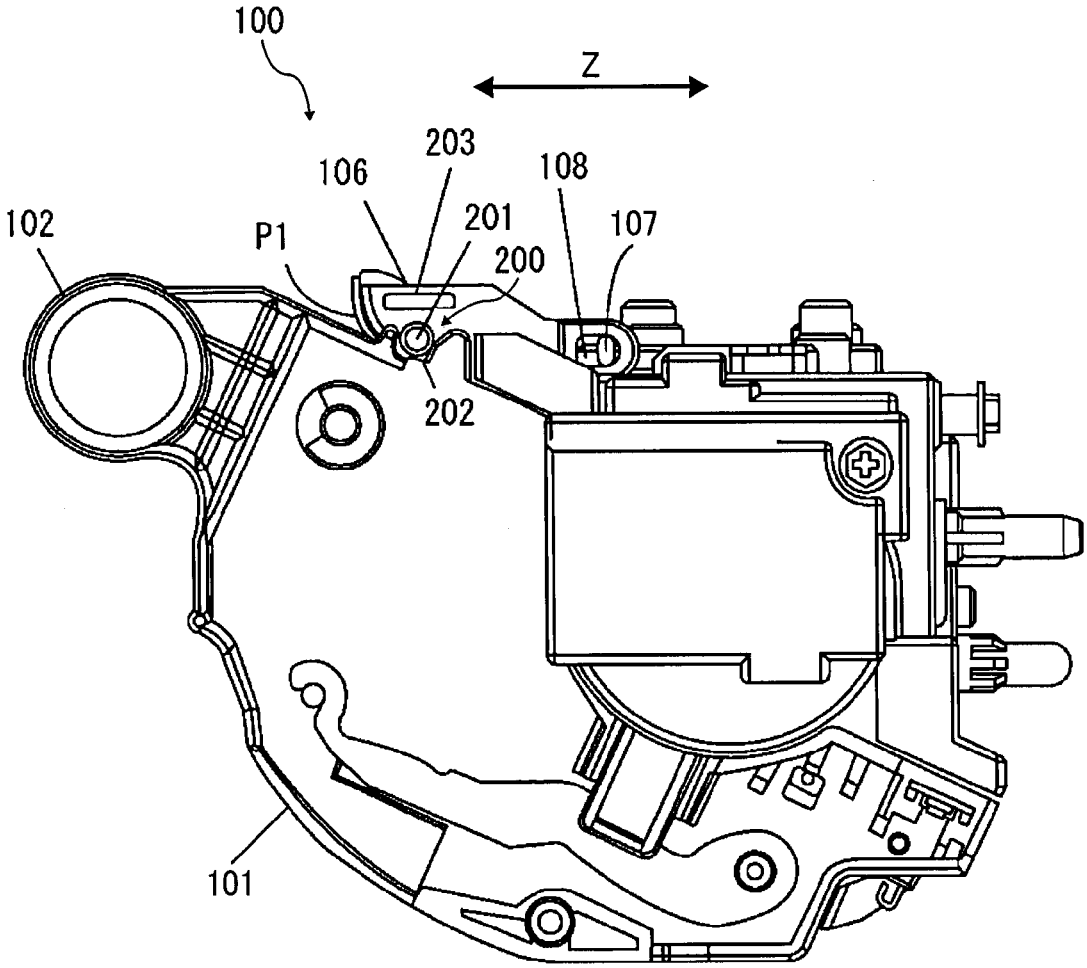
FIG. 8 is a diagram illustrating an example of an engaging configuration included in the sheet discharge device shown in FIG. 2.
Figure 9:
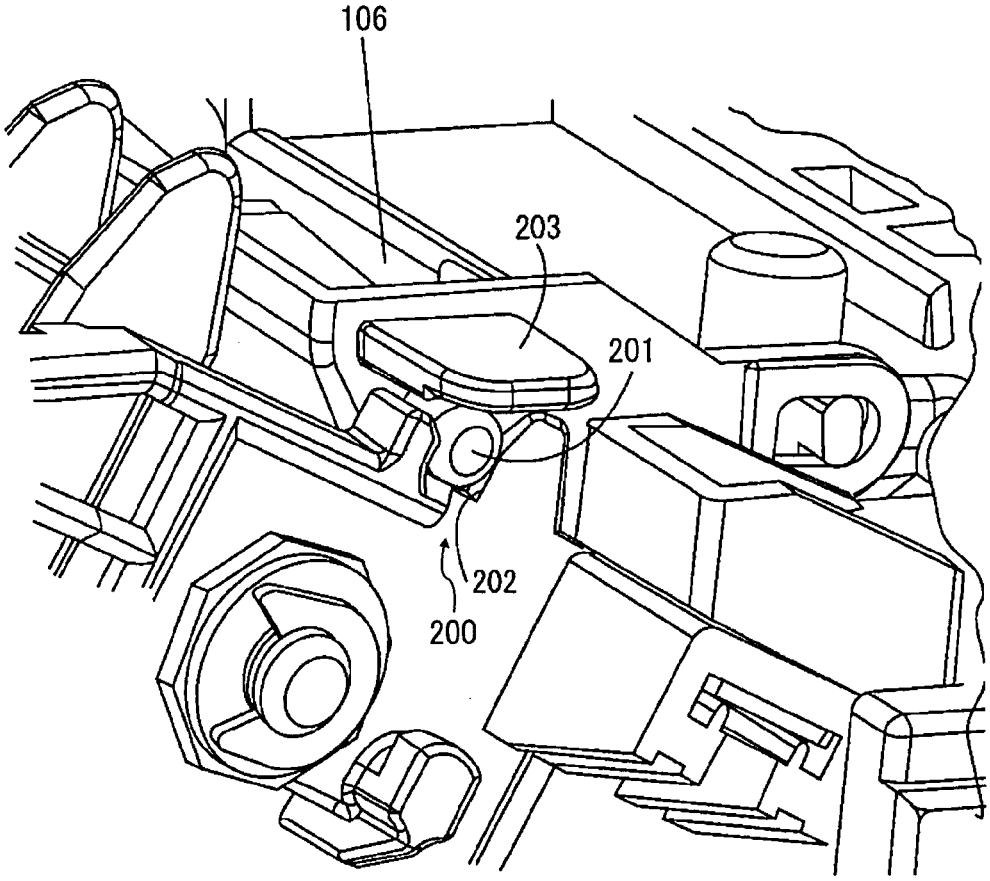
FIG. 9 is a perspective view illustrating an engaging configuration included in the sheet discharge device shown in FIG. 2.

In FIG. 8 and FIG. 9, a holding member 200 includes a projection portion 201 and a concave portion 202. The projection portion 201 is arranged at the guide member 106 and the concave portion 202 is arranged at the sheet discharge device 100. The projection portion 201 is engaged with the concave portion 202 when the guide member 106 is closed, as shown in FIG. 8. The engaged position is decided so that the driven roller 105 can correct the curl of the sheet. As such, this configuration prevents the guide member 106 from moving in a direction of an arrow Z, shown in FIG. 8, regardless of the hole of oblong shape in the engaging part 108.

Figure 10:
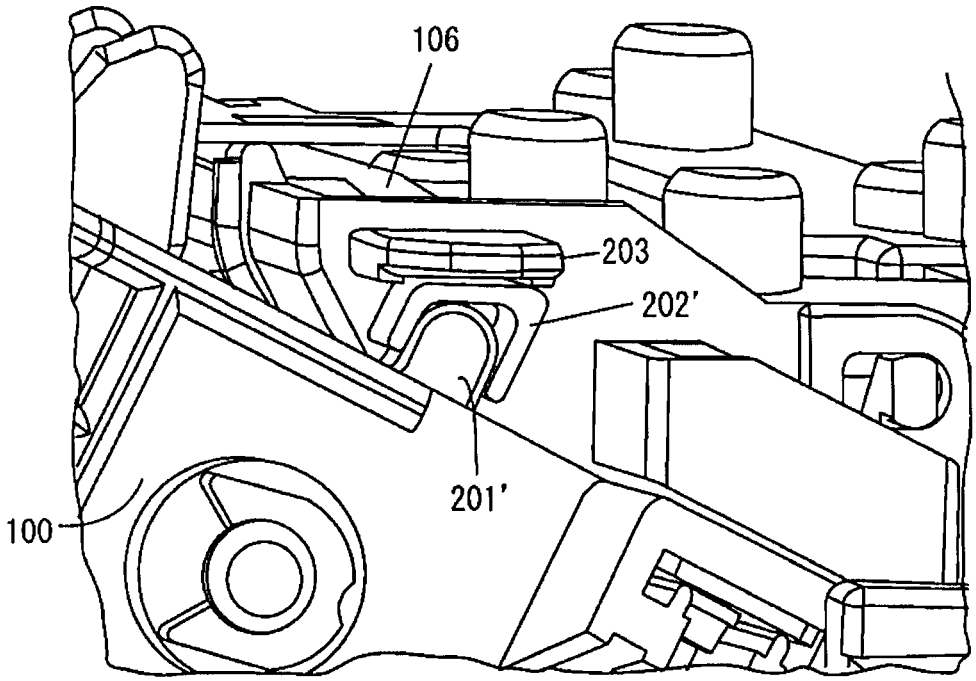
FIG. 10 is a diagram illustrating another example of the engaging configuration shown in FIG. 8.

On the other hand, another configuration may be formed with a projection portion 201' arranged at the sheet discharge device 100 and a concave portion 202' arranged at the guide member 106, as shown in FIG. 10.

In one example, a handle 203 shown in FIG. 8 to FIG. 10 is used when a user opens the guide member 106.

Figure 11:
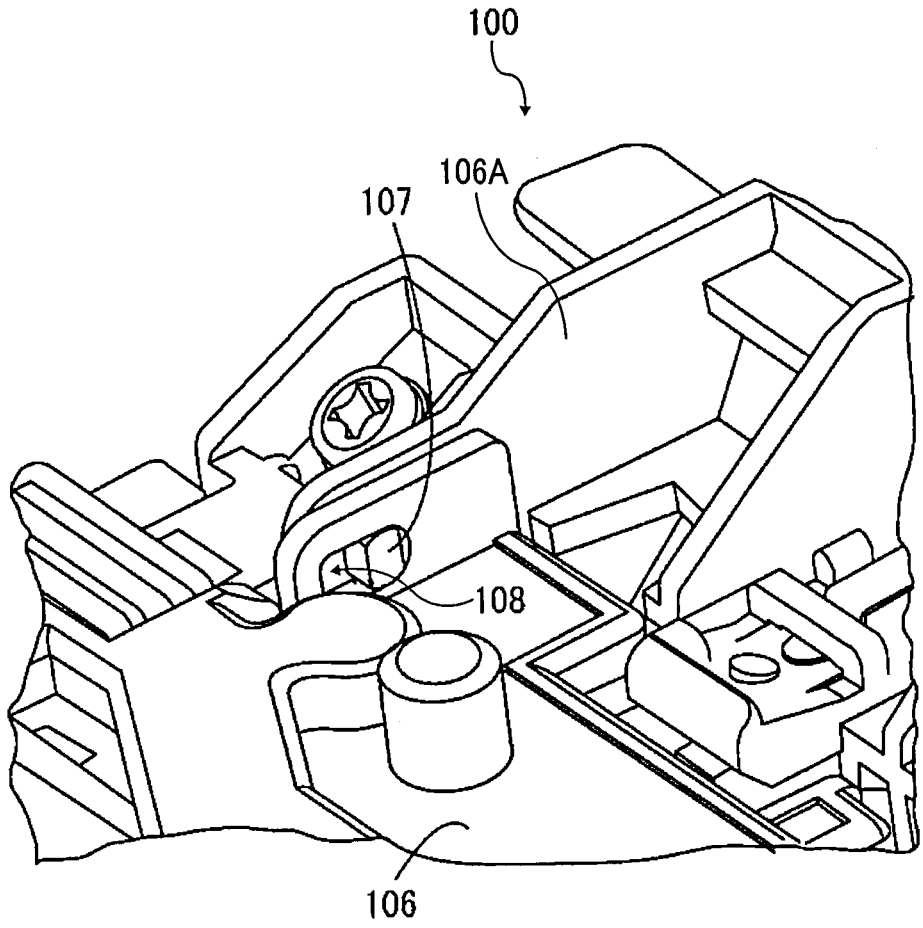
FIG. 11 is a diagram illustrating another example of the configuration shown in FIG. 4.

On the other hand, another configuration may be formed with the support shaft 107 arranged at a guide member 106A and the engaging part 108 arranged at the sheet discharge device 100, as shown in FIG. 11.

The invention claimed is:

1. A sheet discharge device, comprising:

a fixing device that fixes a sheet;

a curl correcting device that corrects a curl of the fixed sheet;

a first guiding member that guides the fixed sheet in a sheet discharging direction;

a second guiding member that guides the fixed sheet in the sheet discharging direction and is arranged on a side opposite to the first guiding member;

a support part that rotatably supports the first guiding member; and a discharging roller pair that discharges the fixed sheet;

wherein the curl correcting device includes a correcting roller that is attached to the first guiding member, the correcting roller presses the fixed sheet in a direction apart from the first guiding member to remove the curl of the fixed sheet when the fixed sheet is held between the discharging roller pair, the correcting roller is apart from the second guiding member when the discharging roller pair is in contact with each other, and the correcting roller contacts with the second guiding member when the discharging roller pair is apart from each other.

2. The sheet discharge device as claimed in claim 1, wherein, the first guiding member is apart from the second guiding member, and is in an opened state that enables removal of a jammed sheet when the first guiding member is rotated in a direction apart from the second guiding member and the correcting roller contacts the second guiding member.

3. The sheet discharge device as claimed in claim 1, further comprising:

a projection portion that is arranged at the first guiding member, and a concave portion that is engaged with the projection portion, wherein in an engaged position of the projection portion and the concave portion, the correcting roller corrects the curl of the fixed sheet.

4. An image forming apparatus, comprising:

an image forming device that forms an image on a sheet;

a fixing device that fixes the image formed sheet;

a curl correcting device that corrects a curl of the fixed sheet;

a first guiding member that guides the fixed sheet in a sheet discharging direction;

a second guiding member that guides the fixed sheet in the sheet discharging direction and is arranged on a side opposite to the first guiding member;

a support part that rotatably supports the first guiding member; and a discharging roller pair that discharges the fixed sheet;

wherein the curl correcting device includes a correcting roller that is attached to the first guiding member, the correcting roller presses the fixed sheet in a direction apart from the first guiding member to remove the curl of the fixed sheet when the fixed sheet is held between the discharging roller pair, the correcting roller is apart from the second guiding member when the discharging roller pair is in contact with each other, and the correcting roller contacts with the second guiding member when the discharging roller pair is apart from each other.

5. A sheet discharge device, comprising:

a heating roller and a pressure roller to fix a sheet;

a curl correcting roller that corrects a curl of the fixed sheet;

a first guide that guides the fixed sheet in a sheet discharging direction;

a second guide that guides the fixed sheet in the sheet discharging direction and is arranged on a side opposite to the first guide;

a support shaft that rotatably supports the first guide; and a discharging roller pair that discharges the fixed sheet;

wherein the curl correcting roller is attached to the first guide, the curl correcting roller presses the fixed sheet in a direction apart from the first guide to remove the curl of the fixed sheet when the fixed sheet is held between the discharging roller pair, the curl correcting roller is apart from the second guide when the discharging roller pair is in contact with each other, and the curl correcting roller contacts with the second guide when the discharging roller pair is apart from each other.

6. The sheet discharge device as claimed in claim 1, further comprising:

an engaging part that engages with the support part, wherein the engaging part includes a hole including an oblong shape so that the first guiding member is movable apart from the second guiding member.

7. The image forming apparatus as claimed in claim 4, further comprising:

an engaging part that engages with the support part, wherein the engaging part includes a hole including an oblong shape so that the first guiding member is movable apart from the second guiding member.

8. The sheet discharge device as claimed in claim 5, further comprising:

an engaging structure that engages with the support shaft, wherein the engaging structure includes a hole including an oblong shape so that the first guide is movable apart from the second guide.

9. The sheet discharge device as claimed in claim 1, wherein, one discharging roller of the discharging roller pair is attached to the first guiding member.

10. The image forming apparatus as claimed in claim 4, wherein, one discharging roller of the discharging roller pair is attached to the first guiding member.

11. The sheet discharge device as claimed in claim 5, wherein, one discharging roller of the discharging roller pair is attached to the first guide.

* * * * *